US009841253B2

(12) United States Patent
Anthony

(10) Patent No.: US 9,841,253 B2
(45) Date of Patent: Dec. 12, 2017

(54) GUN SLING SWIVEL ADAPTER

(71) Applicant: Kyle Anthony, Minco, OK (US)

(72) Inventor: Kyle Anthony, Minco, OK (US)

( * ) Notice: Subject to any disclaimer, the term of this patent is extended or adjusted under 35 U.S.C. 154(b) by 0 days.

(21) Appl. No.: 15/190,858

(22) Filed: Jun. 23, 2016

(65) Prior Publication Data

US 2016/0377371 A1 Dec. 29, 2016

Related U.S. Application Data

(60) Provisional application No. 62/184,630, filed on Jun. 25, 2015.

(51) Int. Cl.
*F41C 33/02* (2006.01)
*F41C 23/02* (2006.01)
*F41C 33/00* (2006.01)

(52) U.S. Cl.
CPC ..... *F41C 23/02* (2013.01); *F41C 33/002* (2013.01)

(58) Field of Classification Search
CPC ..... F41C 23/02; F41C 33/002
USPC ..... 224/150
See application file for complete search history.

(56) References Cited

U.S. PATENT DOCUMENTS 2,078,010 A 4/1937 Meepos
2,102,964 A 12/1937 Mossberg
2,480,662 A 8/1949 McKinzie
2,642,689 A 6/1953 Cline
3,061,965 A 11/1962 Lewis
3,861,070 A 1/1975 Wild et al.
4,614,354 A 9/1986 Stagner
4,817,835 A 4/1989 Tarr, Jr.
5,067,267 A * 11/1991 Ives ..... F41C 23/02 224/150
5,348,205 A 9/1994 Steurer
5,634,289 A 6/1997 Wascher
6,536,153 B2 * 3/2003 Lindsey ..... F41C 33/001 224/150
7,270,254 B2 9/2007 Kakouras
8,640,373 B2 * 2/2014 Burt ..... F41C 23/02 42/85
2004/0178236 A1 * 9/2004 Kakouras ..... F41C 23/02 224/150
2006/0254113 A1 * 11/2006 Esch ..... F41C 23/02 42/85
2010/0162609 A1 * 7/2010 Rogers ..... F41C 23/02 42/85
2011/0138671 A1 * 6/2011 Rogers ..... F41C 23/02 42/85

* cited by examiner

*Primary Examiner* — Corey Skurdal

(57) ABSTRACT

Described herein is an adapter for converting a single sling mount to dual-sling mount. The adapter comprises a body having a modified "H" configuration with two opposing legs joined to two outwardly extending arms. The two opposing legs each have a transverse bore linearly aligned with one another. Each outwardly extending arm also has a transverse bore. The resulting gun sling assembly allows one to carry the gun across one's back in a backpack fashion. An adapter having a modified "Y" configuration allows one to carry a military-style gun across one's back in a backpack fashion.

9 Claims, 10 Drawing Sheets

GUN SLING SWIVEL ADAPTER

CROSS REFERENCE TO RELATED APPLICATIONS/INCORPORATION BY REFERENCE STATEMENT

This application claims priority to U.S. Provisional Application No. 62/184,630 filed Jun. 25, 2015, the content of which is hereby expressly incorporated herein in its entirety.

BACKGROUND OF THE PRESENTLY DISCLOSED INVENTIVE CONCEPTS

1. Field of the Presently Disclosed and/or Claimed Inventive Concepts

The presently disclosed inventive concept(s) relates generally to gun slings and, more particularly, but not by way of limitation, to adapters for converting a single sling mount to dual-sling mount enabling carrying a firearm over two shoulders like a backpack.

2. Brief Description of Related Art

Numerous gun slings have been developed for carrying a long gun, such as a shotgun or rifle, over the shoulder. Gun slings allow a shooter to quickly and safely transition out of a firing position into a position with both hands free. A gun sling can prevent mishaps such as accidental discharge of a dropped gun.

In order to attach a gun sling, most rifles and shotguns come equipped with, or can readily be equipped with a swivel and swivel stud on both the lower and upper end of the gun. Gun swivels are small metal loops used to anchor the sling to the swivel stud. Swivel studs are basically screws secured to the gun and having a transverse bore for threading the swivel.

Typically, a single gun sling is used to carry a gun across one's shoulder. However, it is often desirable for both comfort and security to carry the gun across one's back in a backpack fashion. U.S. Pat. No. 4,817,835 describes a gun sling slit longitudinally. The unslit ends of the strap are looped and attached to swivel rings mounted to the gun. Similarly, U.S. Pat. No. 7,270,254 describes a gun sling system having two slings joined on each end by a Y-strap. The slings can be worn over both shoulders and the Y-straps can be connected to upper and lower single-swivels on a rifle or shot gun.

Such systems allow carrying of the gun over one shoulder and optionally over the back in a backpack fashion; however, special straps are necessary. When worn over one shoulder the straps are necessarily twice as bulky as necessary. When worn across the back with two straps, the section where the straps are joined is bulky and uneven. This can be uncomfortable and can result in abrasion and irritation of the underlying the skin. There remains a need for connectors that will allow either one or two gun slings to be attached, and further allowing a gun with two gun slings to be worn in a backpack fashion. There is also a need to readily convert existing gun sling swivels and studs to accommodate dual slings for comfortable use in a backpack fashion.

SUMMARY OF THE DISCLOSURE

The inventive concepts disclosed and claimed herein relate generally to an adapter for converting a single-sling mount to dual-sling mount. The adapter comprises a body having a modified "H" configuration with two opposing legs joined to two outwardly extending arms. The two opposing legs each have a transverse bore linearly aligned with one another. Each outwardly extending arm also has a transverse bore. The bores in the parallel legs and the bores in the extending arms are positioned in substantially the same plane.

In one embodiment, a long gun sling assembly is wearable across a person's back in a backpack fashion. The long gun sling assembly includes a first swivel stud mountable to an upper portion of a shotgun or rifle and a second swivel stud mountable to a lower portion of a shotgun or rifle. A first clevis shackle is attachable to the first swivel stud with a first clevis pin and includes a first slotted mounting arm and a second slotted mounting arm. A second clevis shackle is attachable to the second swivel stud with a second clevis pin. The second clevis shackle also includes a first slotted mounting arm and a second slotted mounting arm. A first strap includes a loop or ring at an upper end and at a lower end. The upper end loop or ring is attachable through a slot in the first mounting arm of the first clevis shackle, and the lower end loop or ring is attachable through a slot in the first mounting arm of the second clevis shackle. Similarly, a second strap includes a loop or ring at an upper end and at a lower end. The upper end loop or ring is attachable through a slot in the second mounting arm of the first clevis shackle, and the lower end loop or ring is attachable through a slot in the second mounting arm of the second clevis shackle.

BRIEF DESCRIPTION OF THE DRAWINGS

The accompanying drawings, which are incorporated in and constitute a part of this specification, illustrate one or more implementations described herein and, together with the description, explain these implementations. The drawings are not intended to be drawn to scale, and certain features and certain views of the figures may be shown exaggerated, to scale or in schematic in the interest of clarity and conciseness. Not every component may be labeled in every drawing. Like reference numerals in the figures may represent and refer to the same or similar element or function. In the drawings.

DETAILED DESCRIPTION

Figure 1:
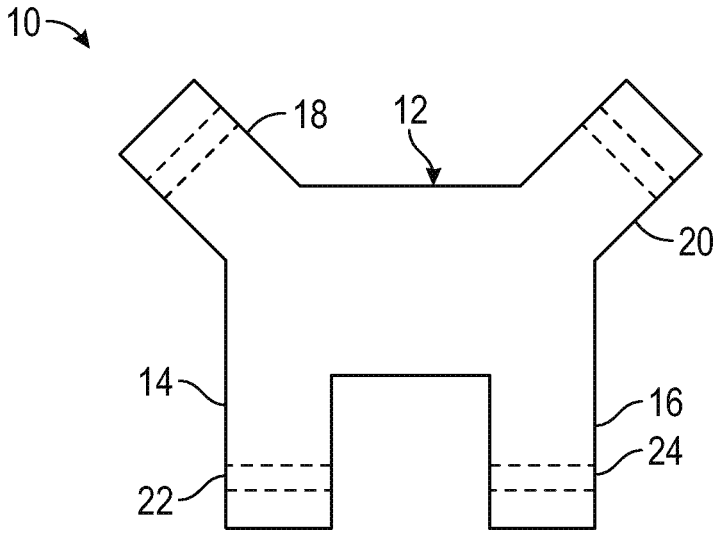
FIG. 1 is a top view of an adapter embodiment for converting a single sling mount to a dual-sling mount, the embodiment constructed in accordance with the inventive concepts disclosed herein.

Before explaining at least one embodiment of the presently disclosed inventive concept(s) in detail, it is to be understood that the presently disclosed inventive concept(s) is not limited in its application to the details of construction and the arrangement of the components or steps or methodologies set forth in the following description or illustrated in the drawings. The presently disclosed inventive concept(s) is capable of other embodiments or of being practiced or carried out in various ways. Also, it is to be understood that the phraseology and terminology employed herein is for the purpose of description and should not be regarded as limiting.

Unless otherwise defined herein, technical terms used in connection with the presently disclosed inventive concept(s) shall have the meanings that are commonly understood by those of ordinary skill in the art. Further, unless otherwise required by context, singular terms shall include pluralities and plural terms shall include the singular.

All of the articles and/or methods disclosed herein can be made and executed without undue experimentation in light of the present disclosure. While the articles and methods of the presently disclosed inventive concept(s) have been described in terms of preferred embodiments, it will be apparent to those of skill in the art that variations may be applied to the articles and/or methods and in the steps or in the sequence of steps of the method described herein without departing from the concept, spirit, and scope of the presently disclosed inventive concept(s). All such similar substitutes and modifications apparent to those skilled in the art are deemed to be within the spirit, scope, and concept of the presently disclosed inventive concept(s).

As utilized in accordance with the present disclosure, the following terms, unless otherwise indicated, shall be understood to have the following meanings:

The use of the word "a" or "an" when used in conjunction with the term "comprising" in the claims and/or the specification may mean "one", but it is also consistent with the meaning of "one or more," "at least one," and "one or more than one." The use of the term "or" in the claims is used to mean "and/or" unless explicitly indicated to refer to alternatives only or that the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects. For example, but not by way of limitation, when the term "about" is utilized, the designated value may vary by plus or minus twelve percent, or eleven percent, or ten percent, or nine percent, or eight percent, or seven percent, or six percent, or five percent, or four percent, or three percent, or two percent, or one percent. The use of the term "at least one of X, Y, and Z" will be understood to include X alone, Y alone, and Z alone, as well as any combination of X, Y, and Z. The use of ordinal number terminology (i.e., "first," "second," "third," "fourth," etc.) is solely for the purpose of differentiating between two or more items and is not meant to imply any sequence or order or importance to one item over another or any order of addition, for example.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AAB, BBC, AAABCCCC, CBBAAA, CABABB, and so forth. The skilled artisan will understand that typically there is no limit on the number of items or terms in any combination unless otherwise apparent from the context.

As used herein, the term "substantially" means that the subsequently described event or circumstance completely occurs or that the subsequently described event or circumstance occurs to a great extent or degree. For example, when associated with a particular event or circumstance, the term "substantially" means that the subsequently described event or circumstance occurs at least 80% of the time, or at least 85% of the time, or at least 90% of the time, or at least 95% of the time. The term "substantially adjacent" may mean that two items are 100% adjacent to one another, or that the two items are within close proximity to one another but not 100% adjacent to one another, or that a portion of one of the two items is not 100% adjacent to the other item but is within close proximity to the other item.

The term "associate" as used herein will be understood to refer to the direct or indirect connection of two or more items.

In the following detailed description of embodiments of the inventive concepts, numerous specific details are set forth in order to provide a more thorough understanding of the inventive concepts. However, it will be apparent to one of ordinary skill in the art that the inventive concepts within the disclosure may be practiced without these specific details. In other instances, well-known features have not been described in detail to avoid unnecessarily complicating the instant disclosure.

Figure 2:
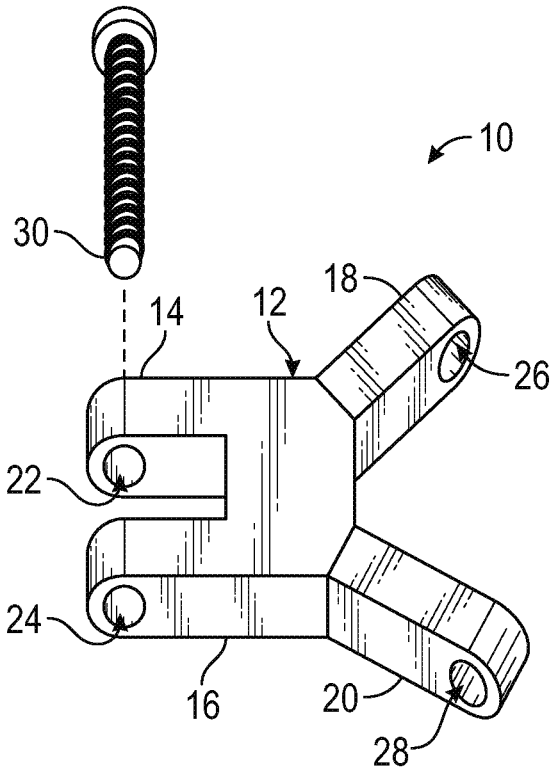
FIG. 2 is a perspective view of the adapter embodiment shown in FIG. 1.

Referring now to FIG. 1 and FIG. 2, an adapter 10 for converting a single sling mount to dual-sling mount comprises a body 12 having a modified "H" configuration with two opposing legs 14 and 16, respectively, joined to two outwardly extending arms 18 and 20, respectively. The two opposing legs 14 and 16, respectively, each have a transverse bore, 22 and 24, the bores 22 and 24 being linearly aligned with one another. The outwardly extending arms 18 and 20, respectively, also have transverse bores 26 and 28. The bores 22 and 24 in the parallel legs 14 and 16, and the bores 26 and 28 in the extending arms 18 and 20 are positioned in substantially the same plane.

The adapter 10 can further include a pin 30 for securing the adapter 10 to, for example, a swivel stud mounted on a shotgun or rifle and as described hereinafter. The pin 30 can be of any type insertable through the bores 22 and 24 of the parallel legs 14 and 16. As is understood by those skilled in the art, the pin 30 includes a means of securing the pin 30 in position. For example, in one embodiment, the pin 30 is a machine screw and the bores 22 and 24 are threaded to accept the machine screw.

A prototype adapter was cut and machined from aluminum bar stock. However, the adapter can be made of any material compatible with the gun and sling assembly components and providing sufficient strength and toughness for carrying the firearm. Examples of suitable materials include, but are not limited to, aluminum, steel, stainless steel, brass, nickel, bronze, and alloys and combinations thereof. Other suitable materials for constructing the adapter can include plastics and composites. Methods for manufacturing the adapter include machining, casting, molding, 3-D printing, and the like.

In one embodiment, the adapter 10 is referred to as a clevis shackle 12. The clevis shackle 12 is attachable to a swivel stud 32 with a clevis pin 30 and includes a first slotted mounting arm 18 and a second slotted mounting arm 20, wherein a slot 26 in the first slotted mounting arm 18 is configured to accept a ring or loop on a first gun sling, and a slot 28 in the second slotted mounting arm 20 is configured to accept a ring or loop on a second gun sling.

Figure 3:
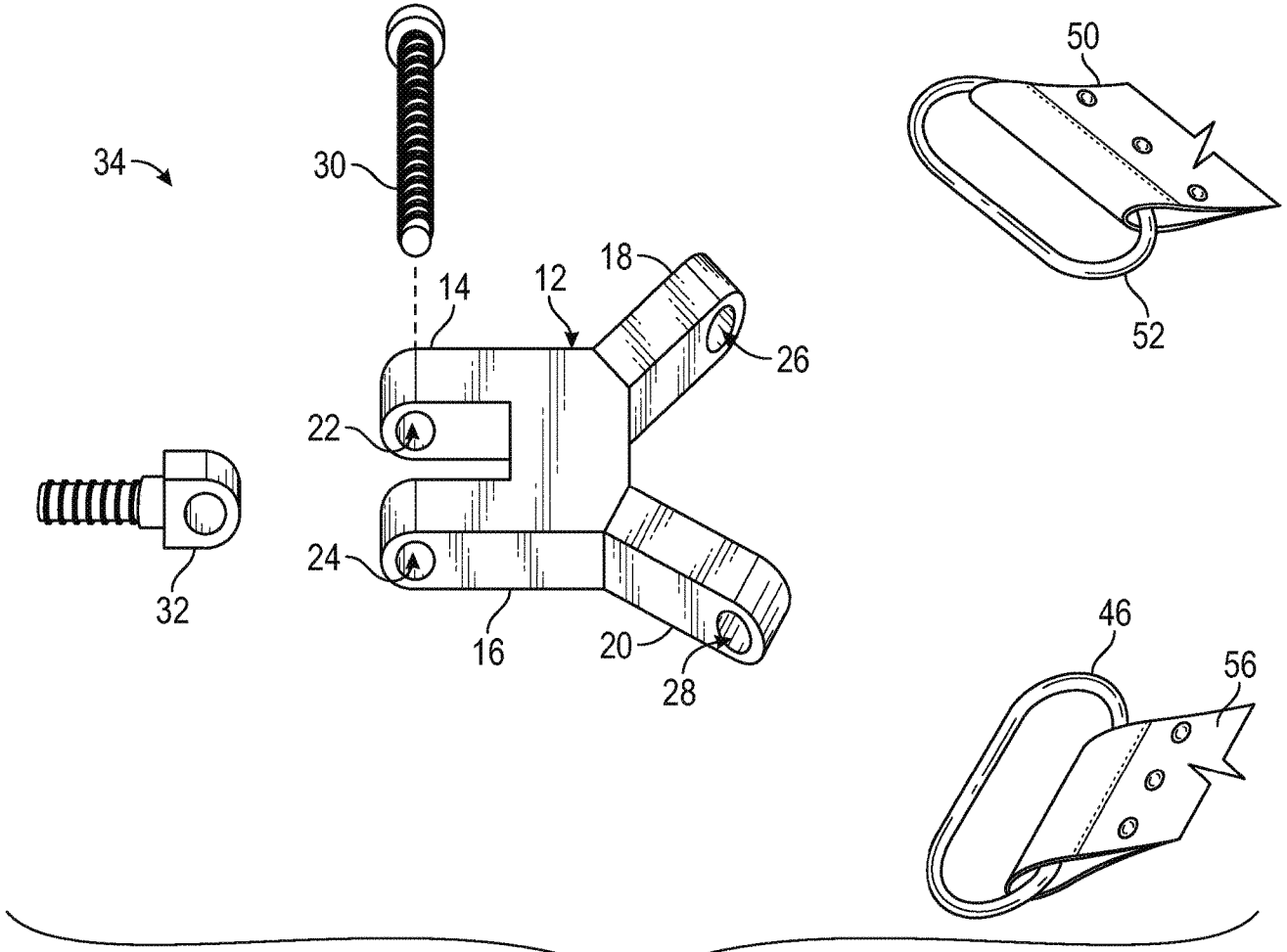
FIG. 3 is a perspective view of a portion of a long gun sling assembly embodiment for attaching to a buttstock end of a gun.
Figure 4:
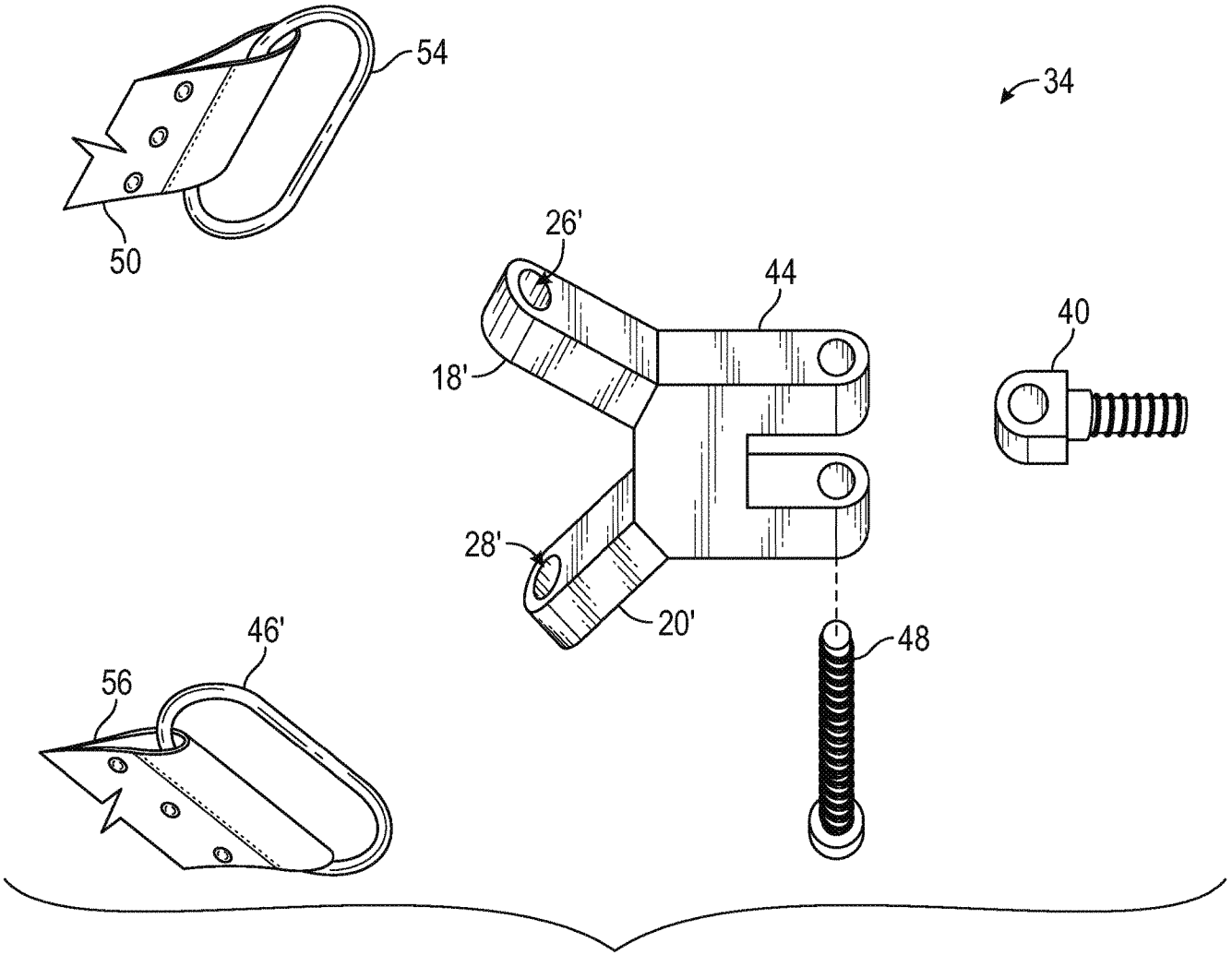
FIG. 4 is a perspective view of a portion of a long gun sling assembly embodiment for attaching to a fore end of a gun.
Figure 7:
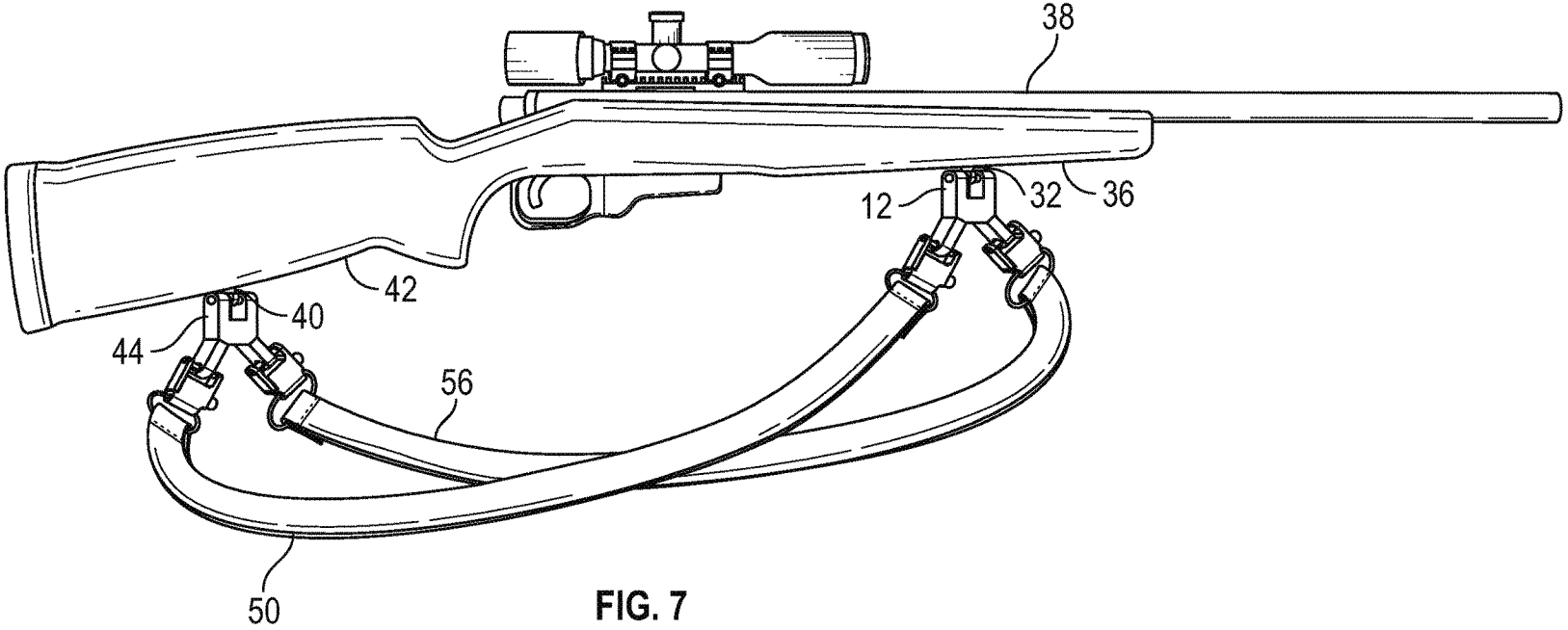
FIG. 7 is a perspective view of a rifle with dual straps attached using an embodiment of the long gun sling assembly constructed in accordance with the inventive concepts disclosed herein.

In another embodiment, and as shown in FIG. 3 and FIG. 4, a long gun assembly 34 accommodates two gun slings allowing the long gun to be worn across a person's back in a back pack fashion. The gun sling assembly 34 includes the first swivel stud 32 mountable or premounted to an upper portion 36 of a shotgun or rifle 38 as shown in FIG. 7. A second swivel stud 40 is mountable or premounted to a lower portion or buttstock 42 of a shotgun or rifle.

The first clevis shackle 12 is attachable to the first swivel stud 32 with a first clevis pin 30 and includes a first slotted mounting arm 18 and a second slotted mounting arm 20 as described above and as shown in FIG. 3.

A second clevis shackle 44, shown in FIG. 4, is attachable to the second swivel stud 40 with a second clevis pin 48. The second clevis shackle 44 also includes a first slotted mounting arm 18' and a second slotted mounting arm 20'.

A first strap 50 includes a loop or ring 52 at an upper end and a ring 54 at a lower end. The upper end loop or ring 52 is attachable to or through the slot 26 in the first mounting arm 18 of the first clevis shackle 12 as shown in FIG. 3. The lower end loop or ring 54 is attachable to or through slot 26' in the first mounting arm 18' of the second clevis shackle 44 as shown in FIG. 4. Similarly, a second strap 56 includes a loop or ring 46 at an upper end and a loop or ring 46' at a lower end. The upper end loop or ring 46 is attachable to or through slot 28 in the second mounting arm 20 of the first clevis shackle 12, and the lower end loop or ring 46' is attachable to or through slot 28' in the second mounting arm 20' of the second clevis shackle 44.

Figure 5:
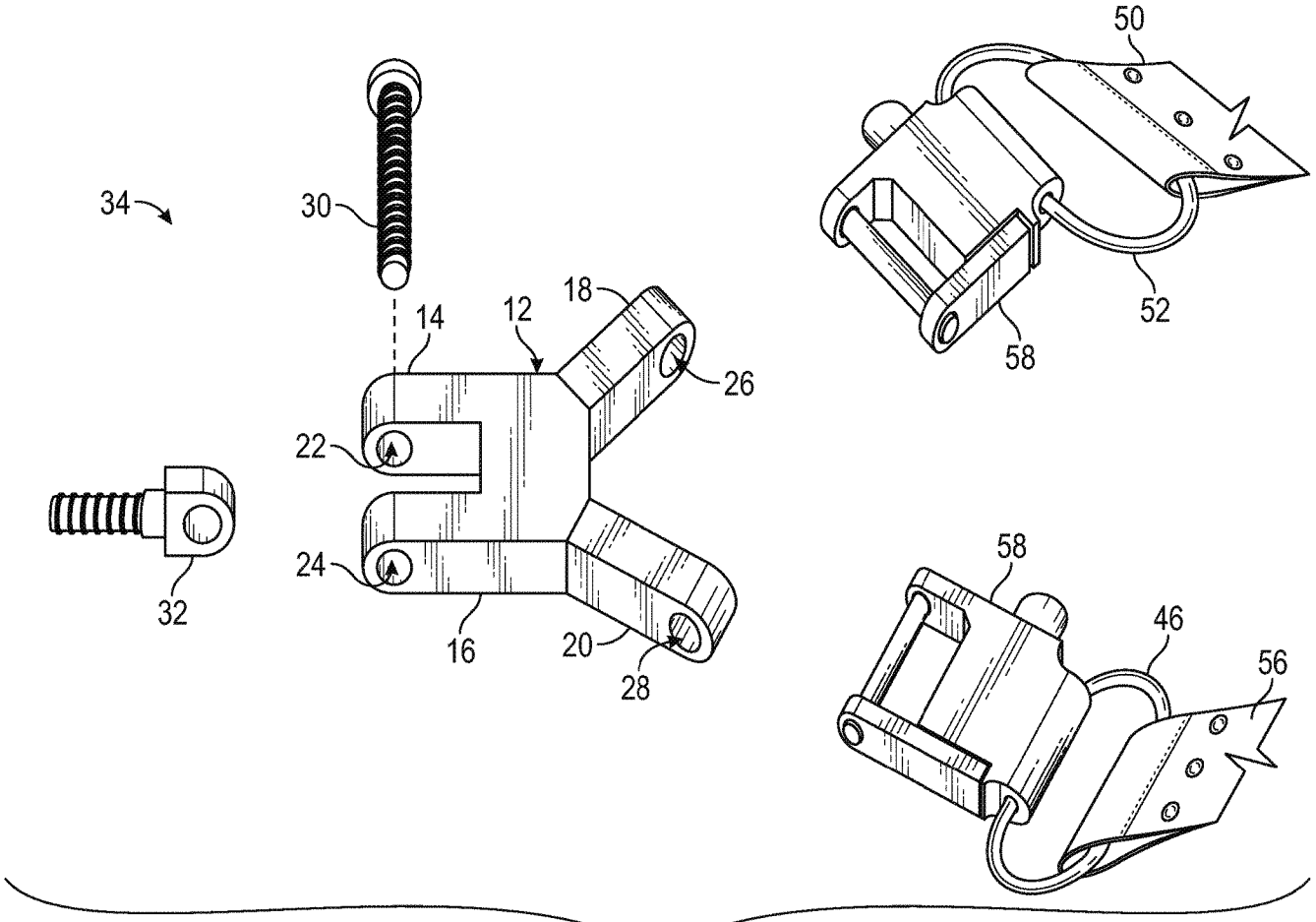
FIG. 5 is a perspective view of a portion of another long gun sling assembly embodiment for attaching to a buttstock end of a gun.
Figure 6:
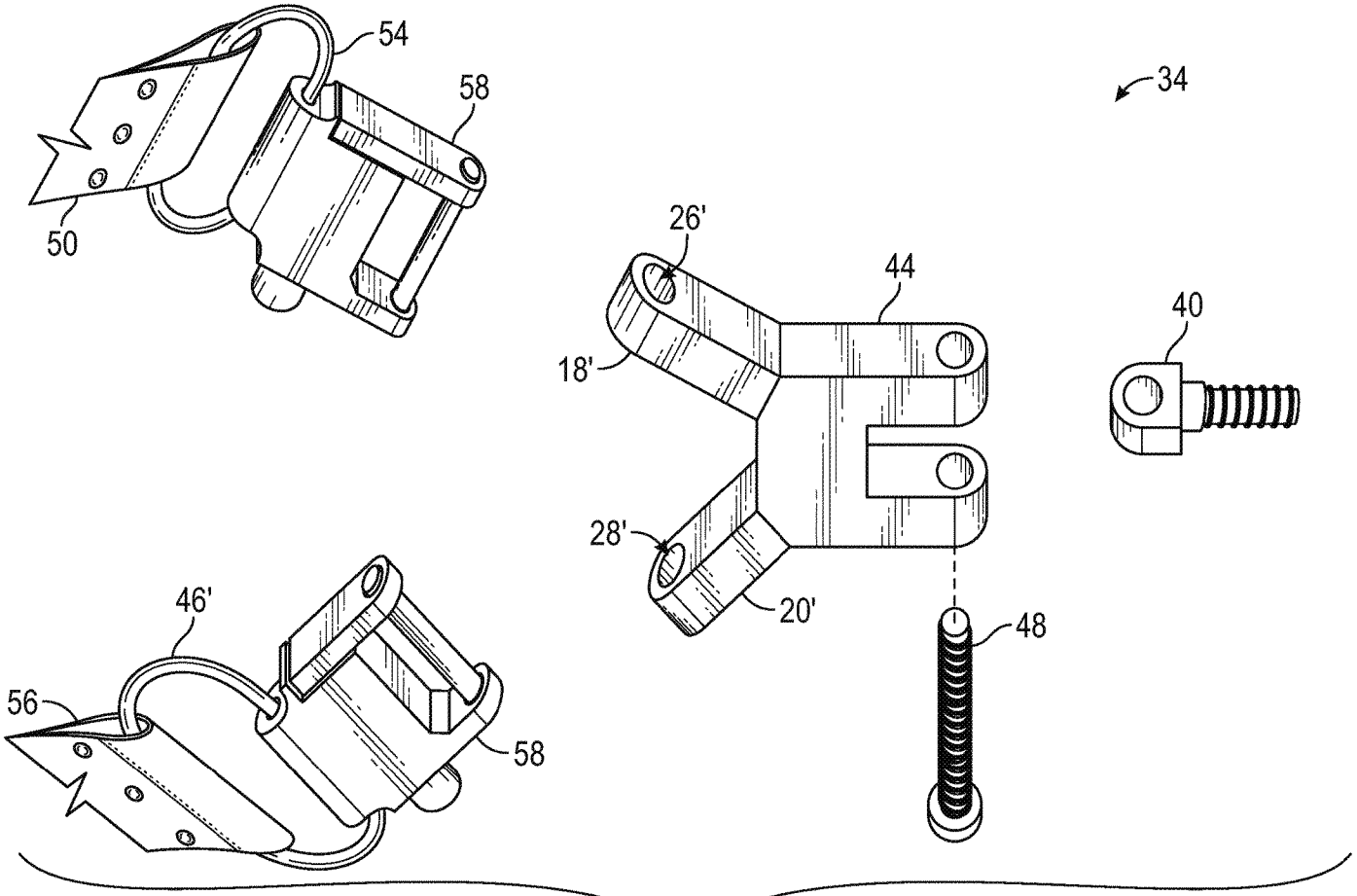
FIG. 6 is a perspective view of a portion of another long gun sling assembly embodiment for attaching to a fore end of a gun.

In one embodiment, as shown in FIG. 5 and FIG. 6, the first and second straps 50 and 56, respectively, are attachable to the first and second clevis shackles 12 and 44, respectively, using sling swivels 58. Sling swivels are readily available from gun and gun accessory manufacturers and suppliers such as Brownells and Midwest Industries. Sling swivels are often detachable using, for example, a push button.

Figure 8:
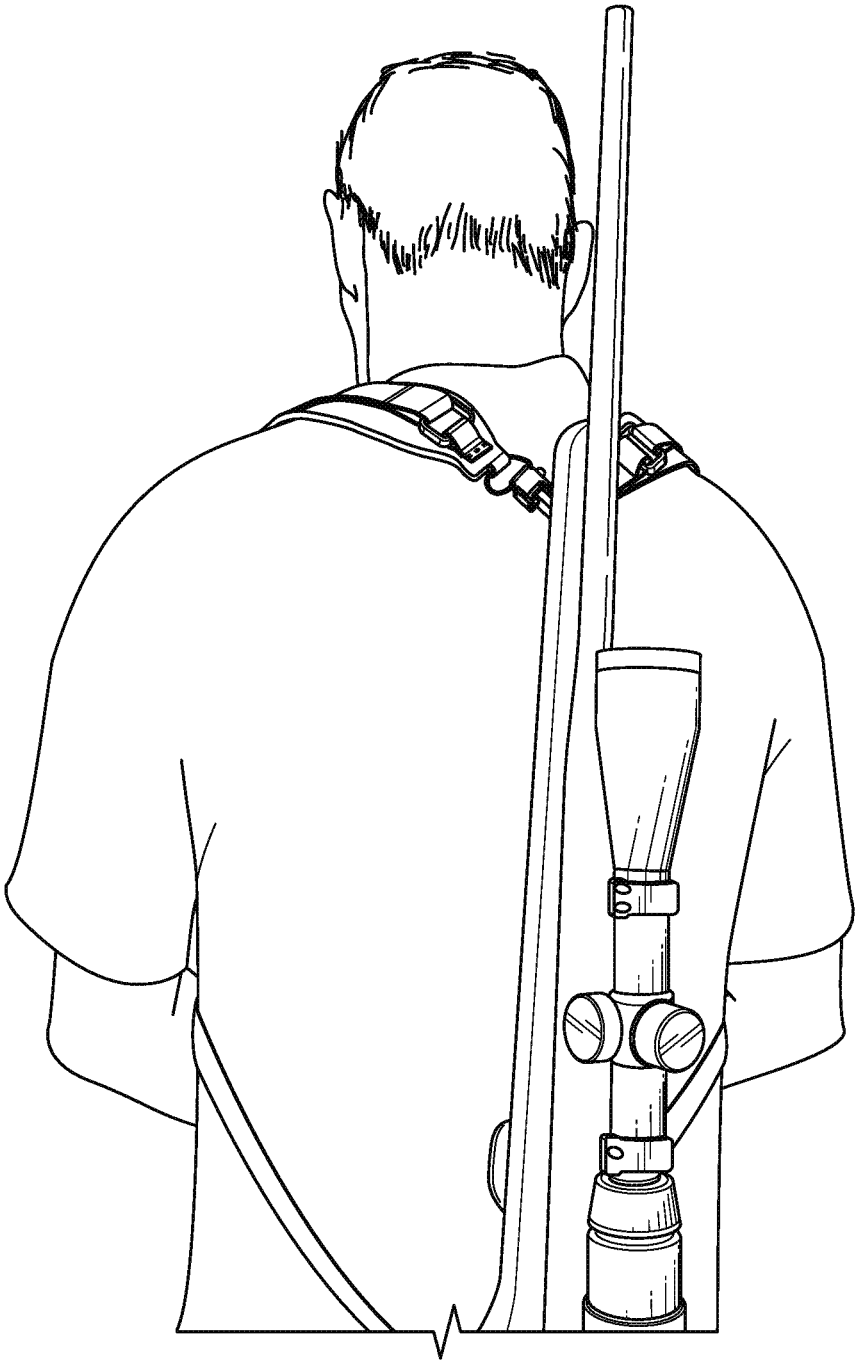
FIG. 8 shows a person using a long gun sling assembly embodiment to carry a firearm over both shoulders like a backpack.

FIG. 7 shows a rifle with dual straps attached using an embodiment of the long gun sling assembly 34. FIG. 8 shows a person using a long gun sling assembly 34 to carry a firearm over both shoulders like a backpack.

Figure 9:
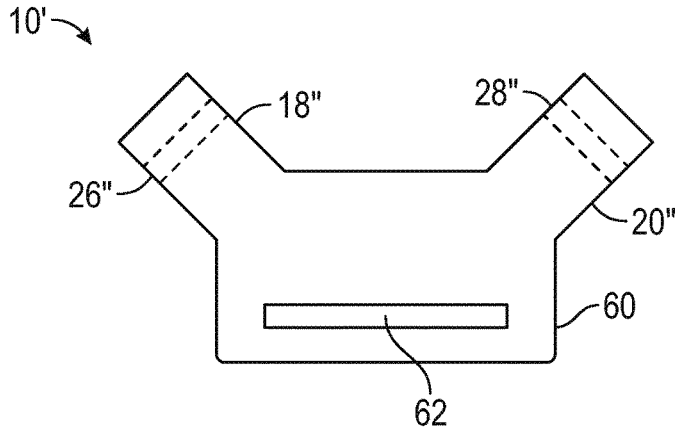
FIG. 9 is a top view of another adapter embodiment for converting a side sling mount to a dual-side sling mount, the embodiment constructed in accordance with the inventive concepts disclosed herein.
Figure 10:
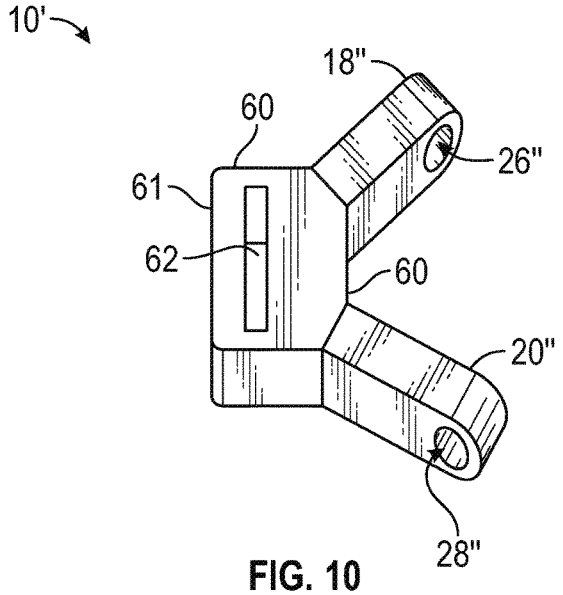
FIG. 10 is a perspective view of the adapter embodiment shown in FIG. 9.

Some military rifles come with long clips and are carried on their side. Such a rifle often comes with swivel studs mounted on the upper and lower portions, but the swivel studs are turned about 90° from those on a standard long gun in order to facilitate carrying the gun on its side using a side strap. The swivel studs in the gun can be rotated about 90° to receive the adapter 10 embodiment described above. Alternatively, adapter 10' as shown in FIG. 9 and FIG. 10 can be used to convert the single sling mount to dual-sling mount without rotating the swivel studs.

Adapter 10' comprises a body 60 having a modified "Y" configuration with two outwardly extending arms 18" and 20" respectively, the outwardly extending arms joined to a base 61. Each outwardly extending arm has a transverse bore therethrough, 26" and 28". The base 61 has a slot 62 therethrough. The bores 26" and 28" in the extending arms 18" and 20" are positioned in a plane substantially perpendicular to a plane extending through the slot 62. Suitable materials for construction of the adapter 10' include, but are not limited to, aluminum, steel, stainless steel, brass, nickel, bronze, alloys, composites, and combinations thereof.

Figure 11:
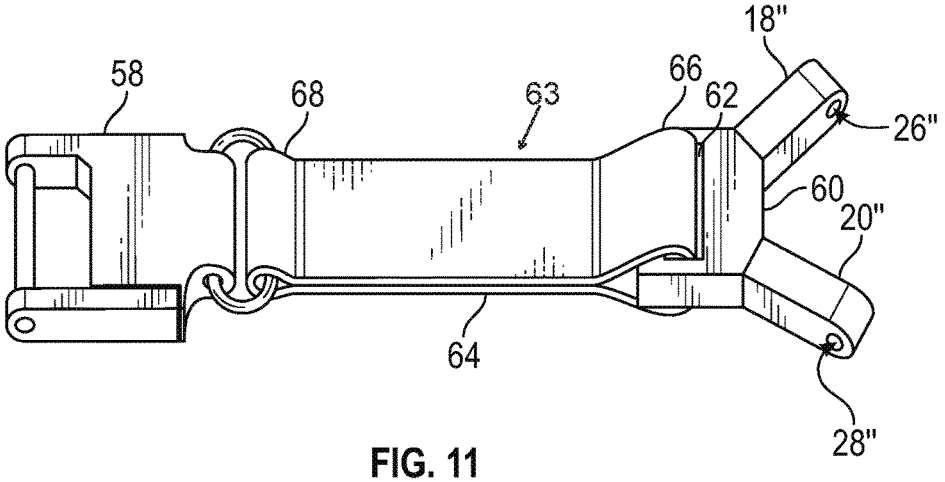
FIG. 11 is a perspective view of an adapter assembly embodiment for attaching to a buttstock end of a military-style rifle.

In one embodiment, an adapter assembly 63 includes the adapter 10' and a flexible strap 64 as shown in FIG. 11. The flexible strap 64 has a first end 66 and a second end 68. The first end 66 is secured to the adapter body 60 through the slot 62. The second end 68 is secured to a sling swivel 58. The sling swivel 58 can be attached to, for example, the second swivel stud 40 in the buttstock 42 of a military-style rifle. The flexible strap 64 can twist to accommodate a change in angle, allowing it to be connected to and used with a pre-existing swivel stud without modifying or adjusting the pre-existing swivel stud.

The adapter assembly 63 can also be attached to a pre-existing swivel stud in the upper portion 36 of a military-style rifle. However, the upper portion 36 typically has hardware present to mount, for example, a picatinny rail swivel mount, which is usable without a strap using the adapter 10 having the modified "H" configuration.

Figure 12:
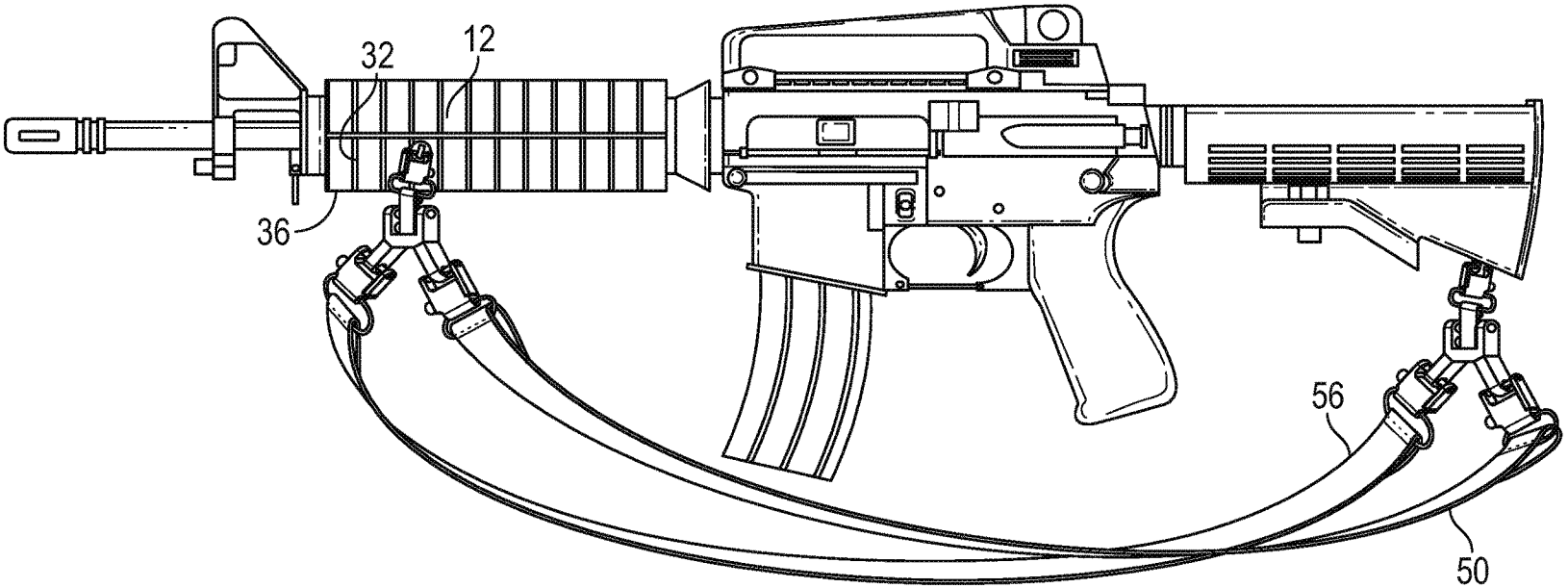
FIG. 12 is a perspective view of a military-style rifle with dual straps attached using a sling assembly embodiment constructed in accordance with the inventive concepts disclosed herein.
Figure 13:
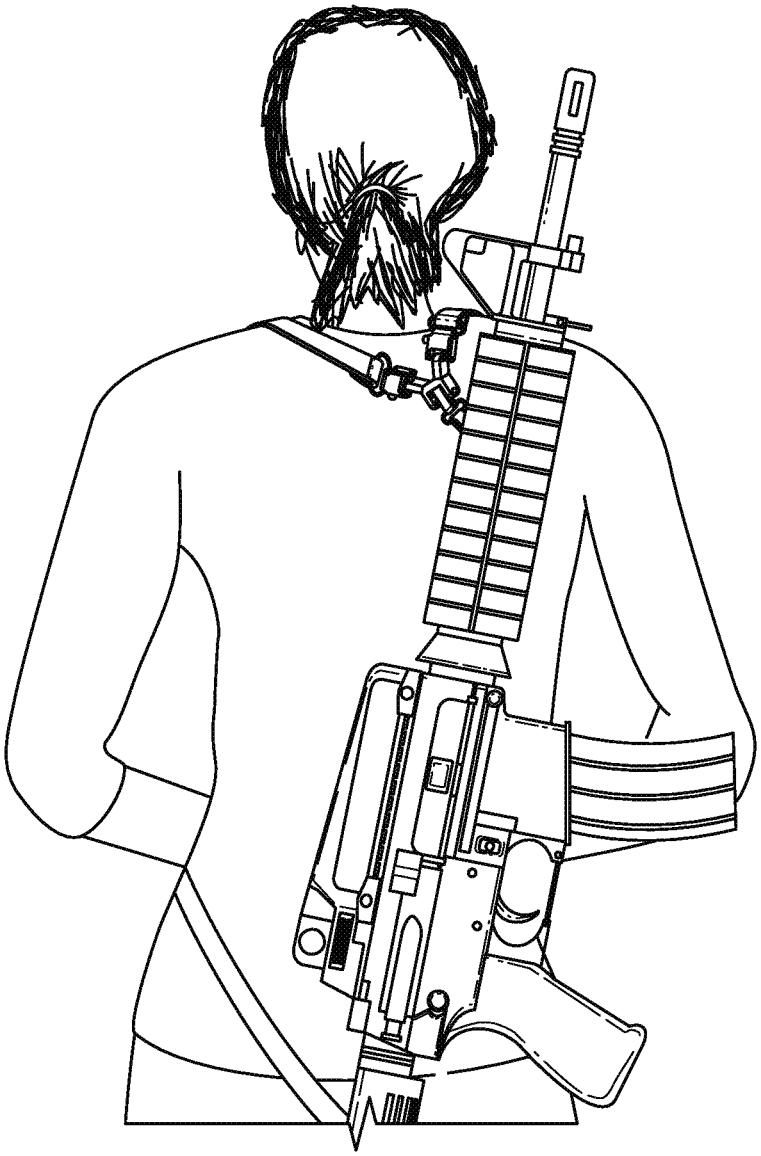
FIG. 13 shows a person using a sling assembly embodiment to carry a military-style rifle over both shoulders like a backpack.

FIG. 12 shows a military-style rifle with dual straps attached using the adapter assembly 63. FIG. 13 shows a person using a sling assembly 34 to carry a military-style rifle over both shoulders like a backpack.

From the above descriptions, it is clear that the presently disclosed and claimed inventive concept(s) is well-adapted to attain the advantages set forth herein above. Although the presently disclosed inventive concept(s) has been described in conjunction with the specific language set forth herein above, it is evident that many alternatives, modifications, and variations will be apparent to those skilled in the art. Accordingly, it is intended to embrace all such alternatives, modifications, and variations that fall within the spirit and broad scope of the presently disclosed inventive concept(s). Changes may be made in the construction and the operation of the various components, elements, and assemblies described herein, as well as in the steps or the sequence of steps of the methods described herein, without departing from the spirit and scope of the presently disclosed inventive concept(s).

What is claimed is:

1. An adapter for converting a single sling mount to dual-sling mount, the adapter comprising a body having a modified "H" configuration comprising two opposing parallel legs joined to two outwardly extending arms, wherein the two opposing parallel legs each have a transverse bore linearly aligned with one another, and wherein each outwardly extending arm has a transverse bore having an axis aligned normal to a lengthwise axis of the outwardly extending arm and sized to receive a single sling swivel, wherein axes of the bores in the opposing parallel legs and axes of the bores in the extending arms are positioned in substantially the same plane, the adapter further comprising a pin securably insertable through the aligned transverse bores in the two opposing parallel legs.

2. The adapter of claim 1, wherein the two opposing parallel legs are configured to straddle a swivel stud having a transverse bore and attach to the swivel stud using the pin, the pin threaded through each of the transverse bores in the opposing parallel legs and the transverse bore in the swivel stud.

3. The adapter of claim 1, wherein the body comprises a metal, plastic, composite, or combination thereof.

4. The adapter of claim 1, wherein the body comprises a metal selected from the group consisting of aluminum, steel, stainless steel, brass, nickel, bronze, alloys and combinations thereof.

5. A long gun sling fastener, comprising:

a swivel stud mountable to a shotgun or rifle;

a clevis shackle attachable to the swivel stud with a clevis pin, the clevis shackle including a first mounting arm and a second mounting arm, each mounting arm having a bore with an axis aligned normal to a lengthwise axis of the mounting arm and sized to receive a single sling swivel on a gun sling, wherein axes of the bores in the mounting arms are positioned in substantially the same plane.

6. A long gun sling assembly wearable across a person's back in a backpack fashion, the long gun sling assembly comprising:

a first swivel stud mountable to an upper portion of a shotgun or rifle;

a second swivel stud mountable to a lower portion of a shotgun or rifle;

a first clevis shackle attachable to the first swivel stud with a first clevis pin, the first clevis shackle including a first and second outwardly extending mounting arm, each outwardly extending mounting arm having a transverse bore with an axis aligned normal to a lengthwise axis of the outwardly extending mounting arm, the arms and the bores extending axially in substantially the same plane;

a second clevis shackle attachable to the second swivel stud with a second clevis pin, the second clevis shackle including a first and second outwardly extending mounting arm, each outwardly extending mounting arm having a transverse bore aligned normal to a lengthwise axis of the outwardly extending mounting arm, the arms and the bores extending axially in substantially the same plane;

a first strap having an upper end and a lower end, the upper end having a sling swivel attachable through the transverse bore in the first mounting arm of the first clevis shackle, and the lower end having a sling swivel attachable through the transverse bore in the first mounting arm of the second clevis shackle; and a second strap having an upper end and a lower end, the upper end having a sling swivel attachable through the transverse bore in the second mounting arm of the first clevis shackle, and the lower end having a sling swivel attachable through the transverse bore in the second mounting arm of the second clevis shackle.

7. An adapter for converting a single sling mount to a dual-sling mount, the adapter comprising a body having a modified "Y" configuration comprising two outwardly extending arms joined to a base, each outwardly extending arm having a transverse bore with an axis aligned normal to a lengthwise axis of the outwardly extending mounting arm, the transverse bore axes positioned in a single plane, the base having a slot therethrough, and the single plane defining a maximum cross-section of the slot.

8. The adapter of claim 7, further comprising a strap having a first end and a second end, the first end secured to the adapter body through the slot, the second end secured to a sling swivel.

9. The adapter of claim 7, wherein the body comprises a metal selected from the group consisting of aluminum, steel, stainless steel, brass, nickel, bronze, alloys and combinations thereof.

* * * * *